US008786397B1

(12) United States Patent
Li et al.

(10) Patent No.: US 8,786,397 B1
(45) Date of Patent: Jul. 22, 2014

(54) ELECTRIC FIELD RESISTOR

(71) Applicant: Excelliance MOS Corporation, Hsinchu County (TW)

(72) Inventors: Chin-Chieh Li, Hsinchu County (TW); Hung-Che Chou, Hsinchu County (TW); Pao-Chuan Lin, Hsinchu County (TW)

(73) Assignee: Excelliance MOS Corporation, Hsinchu County (TW)

( * ) Notice: Subject to any disclaimer, the term of this patent is extended or adjusted under 35 U.S.C. 154(b) by 7 days.

(21) Appl. No.: 13/762,334

(22) Filed: Feb. 7, 2013

(51) Int. Cl.
*H01C 7/22* (2006.01)

(52) U.S. Cl.
USPC ..... 338/295; 338/297; 338/298

(58) Field of Classification Search
USPC ..... 338/295, 297
See application file for complete search history.

(56) References Cited

U.S. PATENT DOCUMENTS

| | | | | |
|---|---|---|---|---|
| 4,139,833 | A * | 2/1979 | Kirsch | 338/308 |
| 5,053,743 | A * | 10/1991 | Mille et al. | 338/297 |
| 5,382,826 | A * | 1/1995 | Mojaradi et al. | 257/489 |
| 6,222,247 | B1 * | 4/2001 | Tung | 257/536 |
| 7,034,651 | B2 * | 4/2006 | Bohlinger | 338/100 |
| 8,089,337 | B2 * | 1/2012 | Brummell et al. | 338/204 |

* cited by examiner

*Primary Examiner* — Kyung Lee
(74) *Attorney, Agent, or Firm* — Jianq Chyun IP Office

(57) ABSTRACT

An electric field resistor includes N coils. N coils encircle a common center in sequence, and each of the coils has a first terminal and a second terminal, wherein the first terminal of the first coil receives a first reference voltage, the second terminal of the $N^{th}$ coil receives a second reference voltage. The second terminal of the $i^{th}$ coil is coupled to the first terminal of the $(i+1)^{th}$ coil, wherein N is a positive integer greater than 1 and $1 \leq i < N$. Besides, a distance between the $i^{th}$ coil and the $(i+1)^{th}$ coil is in direct proportion to a voltage difference between the first terminal and the second terminal of the $(i+1)^{th}$ coil.

7 Claims, 4 Drawing Sheets

ELECTRIC FIELD RESISTOR

FIELD OF THE INVENTION

The invention relates to an electric field resistor, and more particularly, the invention relates to an electric field resistor that provides an electric field resistor that balances electric fields.

DESCRIPTION OF RELATED ART

Referring to FIG. 1. FIG. 1 is a conventional electric field resistor 100. The electric field resistor 100 is often applied to an application domain of high voltages, wherein multiple annular-shaped coils are used to construct the electric field resistor 100, wherein one terminal A1 of the electric field resistor 100 can receive high voltages HV1, and another terminal A2 of the electric field resistor 100 can be coupled to a reference ground voltage SND. A voltage value of the high voltages HV1 is approximately 200V.

In the conventional electric field resistor 100, a distance between each layer of the coils is almost identical. In brief, in FIG. 1, a distance d1 is almost identical to a distance d2. In a situation like this, since a length of each layer of the coils is not the same, a voltage difference generated on each layer of the coils is not the same. In a situation like this, electric fields generated on each layer of the coils in the conventional electric field resistor 100 create different phenomenon. Accordingly, the electric fields generated by the electric field resistor 100 are not uniform and have an impact on effects of a system where the electric field resistor 100 belongs.

SUMMARY OF THE INVENTION

The invention provides an electric field resistor for providing uniform and steady electric fields.

The electric field resistor of the invention includes N coils. The coils encircle a common center in sequence, and each of the coils has a first terminal and a second terminal, wherein the first terminal of the first coil receives a first reference voltage, the second terminal of the $N^{th}$ coil receives a second reference voltage. The second terminal of the $i^{th}$ coil is coupled to the first terminal of the $(i+1)^{th}$ coil, wherein N is a positive integer greater than 1 and $1 \leq i < N$. Besides, a distance between the $i^{th}$ coil and the $(i+1)^{th}$ coil is in direct proportion to a voltage difference between the first terminal and the second terminal of the $(i+1)^{th}$ coil.

In one embodiment of the invention, a resistance value of the $(i+1)^{th}$ coil is greater than that of the $i^{th}$ coil.

In one embodiment of the invention, a voltage difference between the first terminal and the second terminal of the $(i+1)^{th}$ coil is greater than a voltage difference between the first terminal and the second terminal of the $i^{th}$ coil.

In one embodiment of the invention, a shape of the coil is a circular arc and a geometric center of the coil is a common center.

In one embodiment of the invention, a shape of the coil is a symmetric polygonal shape and a geometric center of the coil is a common center.

In one embodiment of the invention, a distance between the $i^{th}$ coil and a common center is shorter than a distance between the $(i+1)^{th}$ coil and a common center.

In one embodiment of the invention, each of the coils provides an uniform electric field.

Based on the above, an electric field resistor of the invention is formed via cascading a plurality of the coils in series, and distances between each of the coils are adjusted based on voltage differences generated by each of the coils. As such, each coil can generate almost identical size of an electric field for the electric field resistor to provide uniform electric fields.

In order to make the aforementioned features and advantages of the invention more comprehensible, several embodiments accompanied with figures are described in details below.

DETAILED DESCRIPTION OF THE EMBODIMENTS

Figure 1:
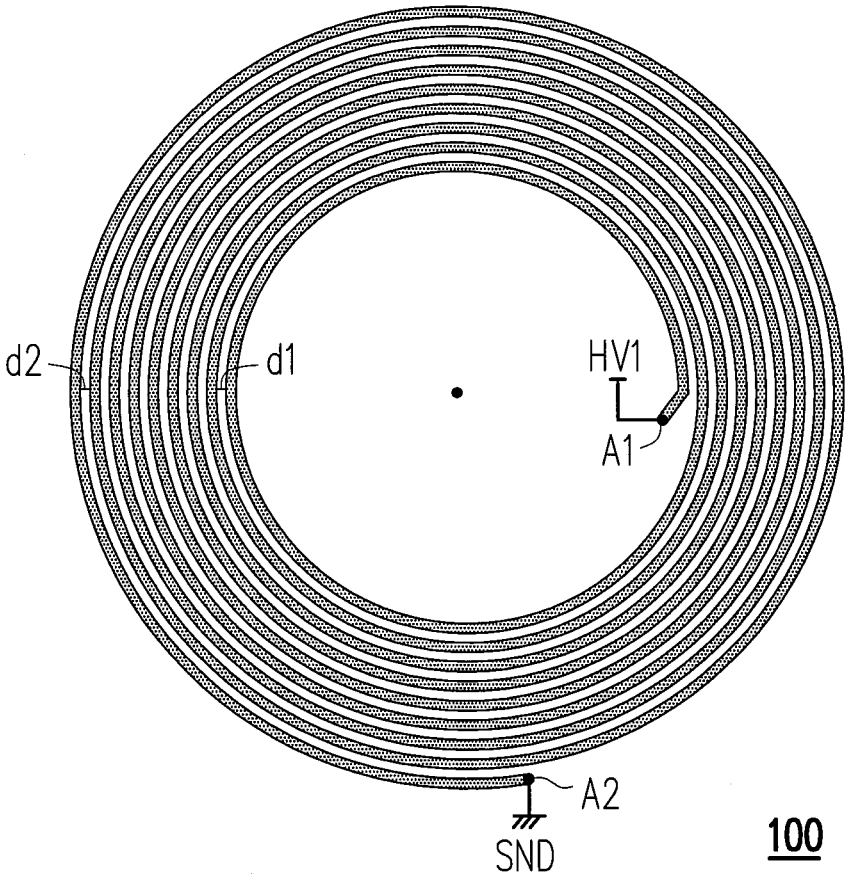
FIG. 1 is a conventional electric field resistor 100.
Figure 2:
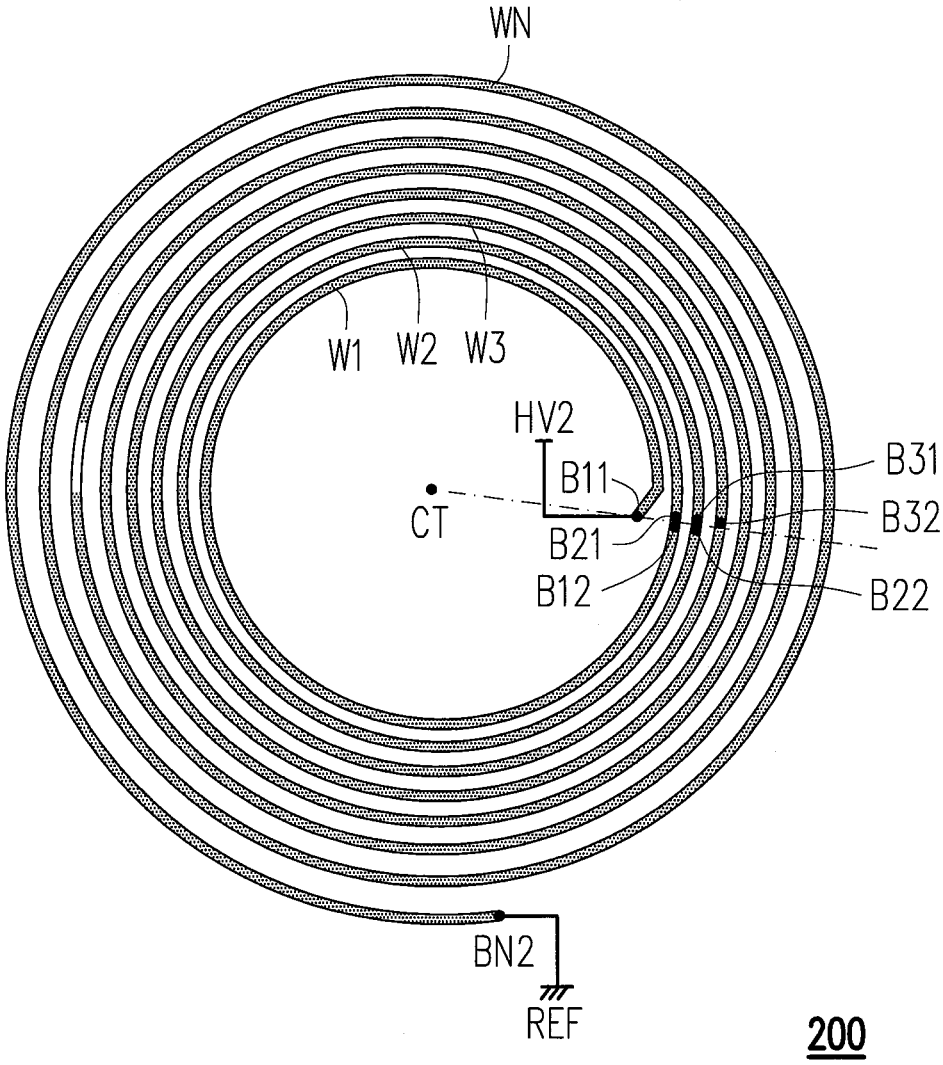
FIG. 2 is a schematic view of an electric field resistor 200 according to an embodiment of the invention.

Referring to FIG. 2. FIG. 2 is a schematic view of an electric field resistor 200 according to an embodiment of the invention. The electric field resistor 200 includes a plurality of coils W1-WN. The coils W1-WN encircle a common center CT in sequence for dispositions. Each of the coils W1-WN has a first terminal and a second terminal. Take coils W1~W3 as an example. The coil W1 has a first terminal B11 and a second terminal B12. The coil W2 has a first terminal B21 and a second terminal B22, and the coil W3 has a first terminal B31 and a second terminal B32. In the present embodiment, the first terminal B11 of the coil W1 is configured to receive a first reference voltage HV2, and a second terminal BN2 of the coil WN is configured to receive a second reference voltage REF, wherein the first reference voltage HV2 can be, for example, a voltage of 200V and the second reference voltage REF can be, for example a ground voltage of 0V.

In addition, the second terminal of each of the coils W1-WN is directly connected with the first terminal of an adjacent coil. For example, the second terminal B12 of the coil W1 is directly connected with the first terminal B21 of the coil W2, and the second terminal B22 of the coil W2 is directly connected with the first terminal B31 of the coil W3.

Figure 3:
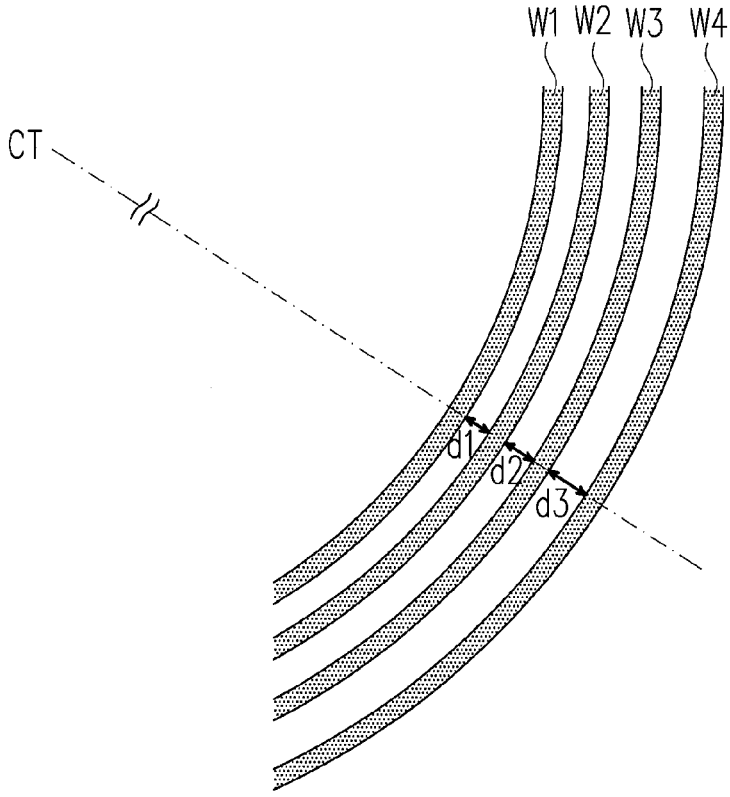
FIG. 3 is a partially enlarged schematic view of the electric field resistor 200.

Referring FIG. 3. It should be noted further that FIG. 3 is a partially enlarged schematic view of the electric field resistor 200. In FIG. 3, a distance d1 between the coil W1 and the coil W2, a distance d2 between the coil W2 and the coil W3, and a distance d3 between the coil W3 and a coil W4 are different, wherein the distance d1, the distance d2 and the distance d3 are determined based on voltage differences between the first terminal and the second terminal of the coil W2, the coil W3 and the coil W4, respectively. It should be also mentioned that the aforementioned distances d1~d3 are the shortest distances between two adjacent coils W1~W4. In brief, the distance d1 is the shortest distance between the coil W1 and the coil W2, the distance d2 is the shortest distance between the coil W2 and the coil W3, and the distance d3 is the shortest distance between the coil W3 and the coil W4.

Referring to FIG. 2 and FIG. 3 at the same time. In the present embodiment, a length of the coil W2 is obviously shorter than a length of the coil W3. In an example that the coil W2 and the coil W3 have the same width, a voltage difference between the first terminal B31 and the second terminal B32 of the coil W3 is obviously greater than a voltage difference between the first terminal B21 and the second terminal B22 of the coil W2. As a result, the distance d3 is greater than the distance d2.

Regarding setting a size of a distance, when a voltage difference between the first terminal and the second terminal of a coil is greater than a preset value V0, a designer can adjust a distance based on the preset value V0, wherein a relationship between a voltage difference and a distance is shown in Formula (1):

$$V(r) = V0 - \frac{\int dL}{L0} = V0 - \int_0^{\phi} r\,d\theta \tag{1}$$

In Formula (1), V(r) is a voltage difference calculated based on a variation of a distance from the common center to the coil. L is a distance that is needed for adjustments. L0 is a minimum safe distance between the coils, and θ is angular degrees.

When V(r) is a voltage difference being a fixed number, which is calculated based on a variation of a distance from the common center to the coil, and a differentiation is performed to both sides of the Formula (1), the following Formula (2) is acquired:

$$\frac{dV}{dr} = 0 - \frac{1}{L0} * r * \frac{d\theta}{dr} = k,\ k \text{ is a constant} \tag{2}$$

Then the following deduction is performed based on the Formula (2):

$$\begin{aligned} &\Rightarrow \frac{L0}{r} * \frac{d\theta}{dr} = \frac{1}{k} = K \\ &\Rightarrow \frac{L0}{r} * dr = K d\theta \\ &\Rightarrow \int \frac{1}{r} dr = \int K * d\theta \\ &\Rightarrow \ln r = K * \theta + C \\ &\Rightarrow r = C * e^{K*\theta}, \\ &C \text{ is a constant} \end{aligned} \tag{3}$$

Based on the above Formula (3), when V(r) is a voltage difference being a variable, which is calculated based on a variation of a distance from the common center to the coil, a size of r is deducted based on different angular degrees.

In other words, in the present embodiment, a distance among each of the coils W1-WN can be adjusted based on a voltage difference between the first terminal and the second terminal of each of the coils. Therefore, if an electric field which is generated by the coils equals to a distance between a voltage difference and the coils, each of the coils W1-WN can generate a uniform (equivalent) electric field.

Figure 4:
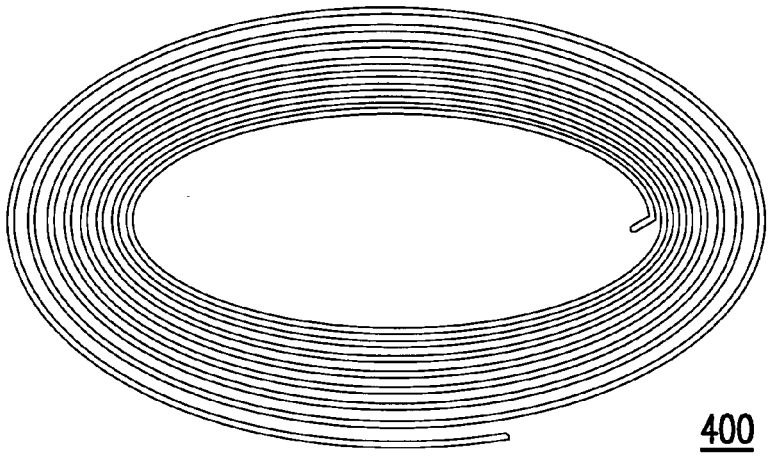
FIG. 4 is a schematic view of an electric field resistor 400 according to an embodiment of the invention.

Referring to FIG. 4. FIG. 4 is a schematic view of an electric field resistor 400 according to an embodiment of the invention. In the present embodiment, the electric field resistor 400 is constructed via a plurality of ellipse coils. In other words, it is not necessary to construct an electric field resistor using circular-shaped coils. The present embodiment may be realized by using ellipse coils for constructing an electric field resistor.

Figure 5:
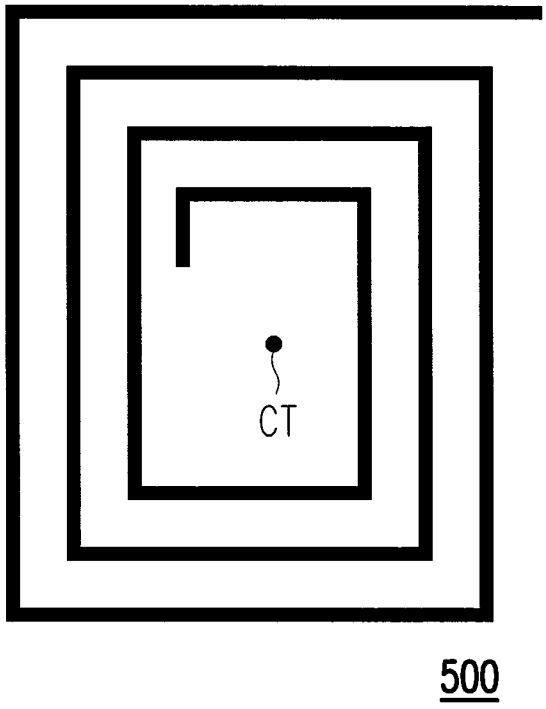
FIG. 5 is a schematic view of an electric field resistor 500 according to an embodiment of the invention.

Referring to FIG. 5. FIG. 5 is a schematic view of an electric field resistor 500 according to an embodiment of the invention. The electric field resistor 500 of the present embodiment is constructed via a plurality of rectangular coils. In other words, a shape of the coils for constructing the electric field resistor 500 can also be a symmetric polygonal shape and a key point is that a geometric center of the coils is the common center CT.

To sum up, the invention uses a plurality of coils to construct an electric field resistor, wherein the common center of the coils is the geometric center. The main point is that, in the invention, a distance between the $i^{th}$ coil and the $(i+1)^{th}$ coil is in direct proportion to a voltage difference between the first terminal and the second terminal of the $(i+1)^{th}$ coil. As such, each coil can generate almost identical size of an electric field for the electric field resistor to provide a uniform electric field.

What is claimed is:

1. An electric field resistor, comprising:

N coils, the coils encircling a common center in sequence, each of the coils having a first terminal and a second terminal, wherein the first terminal of the first coil receives a first reference voltage, the second terminal of the $N^{th}$ coil receives a second reference voltage, and the second terminal of the $i^{th}$ coil is coupled to the first terminal of the $(i+1)^{th}$ coil, wherein N is a positive integer greater than 1 and $1 \le i < N$, wherein a distance between the $i^{th}$ coil and the $(i+1)^{th}$ coil is in direct proportion to a voltage difference between the first terminal and the second terminal of the $(i+1)^{th}$ coil.

2. The electric field resistor as claimed in claim 1, wherein a resistance value of the $(i+1)^{th}$ coil is greater than a resistance value of the $i^{th}$ coil.

3. The electric field resistor as claimed in claim 2, wherein the voltage difference between the first terminal and the second terminal of the of the $(i+1)^{th}$ coil is greater than a voltage difference between the first terminal and the second terminal of the $i^{th}$ coil.

4. The electric field resistor as claimed in claim 1, wherein a shape of the coils is a circular arc and the common center is a geometric center of the coils.

5. The electric field resistor as claimed in claim 1, wherein a shape of the coils is a symmetric polygon and a geometric center of the coils is the common center.

6. The electric field resistor as claimed in claim 1, wherein a distance between the $i^{th}$ coil and the common center is shorter than a distance between the $(i+1)^{th}$ coil and the common center.

7. The electric field resistor as claimed of claim 1, wherein electric fields respectively provided by the coils are equaled.

* * * * *